US006161376A

United States Patent [19]

Uchikawa

[11] Patent Number: 6,161,376

[45] Date of Patent: Dec. 19, 2000

[54] METHOD AND APPARATUS FOR CONTROLLING AIR-FUEL RATIO OF INTERNAL COMBUSTION ENGINE

[75] Inventor: Akira Uchikawa, Atsugi, Japan

[73] Assignee: Unisia Jecs Corporation, Atsugi, Japan

[21] Appl. No.: 09/032,924

[22] Filed: Mar. 2, 1998

[30] Foreign Application Priority Data

Mar. 4, 1997 [JP] Japan ..... 9-049334

[51] Int. Cl.[7] ..... F01N 3/00

[52] U.S. Cl. ..... 60/274; 60/276; 60/285

[58] Field of Search ..... 60/274, 276, 285

[56] References Cited

U.S. PATENT DOCUMENTS

| | | | |
|---|---|---|---|
| 5,363,648 | 11/1994 | Akazaki et al. | 60/276 |
| 5,511,378 | 4/1996 | Lindlbauer et al. | 60/274 |
| 5,566,071 | 10/1996 | Akazaki et al. | 60/285 |
| 5,867,983 | 2/1999 | Otani | 60/285 |

FOREIGN PATENT DOCUMENTS 1-123141 5/1989 Japan .

1-124758 5/1989 Japan .

*Primary Examiner*—Thomas E. Denion

*Attorney, Agent, or Firm*—Foley & Lardner

[57] ABSTRACT

The present invention aims at executing an air-fuel ratio feedback control making use of a wide range air-fuel ratio sensor, such that the purifying performance of an exhaust gas purification catalytic converter is exhibited to the utmost. To this end, fuel is injected from a fuel injection valve by establishing a fuel injection quantity, in consideration of a perturbation control constant for oscillating the air-fuel ratio at a predetermined period with a predetermined amplitude. Thus, even when the air-fuel ratio feedback control is executed making use of the detected result of the wide range air-fuel ratio sensor, it becomes possible to conduct a so-called perturbation control in which the air-fuel ratio of exhaust gas at the inlet portion of the exhaust gas purification catalytic converter is oscillated at a predetermined period with a predetermined amplitude. As a result, there can be effectively caused the adsorption and desorption of oxygen molecules onto and from the surface of the exhaust gas purification catalytic converter, so that the purifying performance of the catalytic converter can be remarkably improved.

6 Claims, 7 Drawing Sheets

METHOD AND APPARATUS FOR CONTROLLING AIR-FUEL RATIO OF INTERNAL COMBUSTION ENGINE

BACKGROUND OF THE INVENTION

1. Field of the Invention

The present invention relates to a method and an apparatus for controlling an air-fuel ratio, utilizing an air-fuel ratio detection result of a so-called wide range air-fuel ratio sensor.

2. Related Art of the Invention

There have been known so-called wide range air-fuel ratio sensors such as disclosed in Japanese Unexamined Patent Publication Nos.1-123141 and 1-124758.

These sensors are adapted to detect a concentration of particular component (such as oxygen) in exhaust gas, and based thereon, the air-fuel ratio of engine is detected over a wide range (in both of lean and rich air-fuel ratio ranges).

However, there exists such a problematic possibility to be noted later, just because the wide range air-fuel ratio sensors are adapted to linearly detect an air-fuel ratio over a wide range from rich to lean.

To be noted before explaining the problematic possibility, it is impossible to accurately seize a deviation amount itself of an actual air-fuel ratio from a theoretical air-fuel ratio, in case that a feedback control of air-fuel ratio is executed based on a proportional-plus-integral control making use of output value from an oxygen sensor which outputs a lean/rich inversion signal for a theoretical air-fuel ratio. Thus, the object (fuel injection quantity or intake air quantity) of the air-fuel ratio control is increased or decreased until the output value of the oxygen sensor is rich/lean inversed at the next time. As a result, this situation is repeated such that the object of the air-fuel ratio control is decreased or increased until the output value of the oxygen sensor is again lean/rich inversed at the next time, once the output value of oxygen sensor has been again rich/lean inversed. The control is performed in such a manner as noted above, so that the actual air-fuel ratio is oscillated or reciprocated at a predetermined period with a relatively large amplitude, about the theoretical air-fuel ratio (i.e., rich/lean inversed at a predetermined period).

With respect now to the problematic possibility, in case that the feedback control of air-fuel ratio is performed making use of a wide range air-fuel ratio sensor which can linearly detect air-fuel ratio over a wide range, from rich to lean, the deviation amount itself of an actual air-fuel ratio from a theoretical air-fuel ratio can be detected even if the actual air-fuel ratio has somewhat deviated from the theoretical air-fuel ratio. As such, the target (fuel injection quantity or intake air quantity) of the air-fuel ratio control is increased or decreased to such an extent corresponding to the deviation amount, to thereby correct or compensate the deviation. Thus, the oscillation amplitude of the actual air-fuel ratio to rich/lean range about the theoretical air-fuel ratio does not become so large as in case of the oxygen sensor.

Just as such, the opportunities or occasions of the rich/lean inversion in the conventional feedback control making use of the wide range air-fuel ratio sensor are decreased for the air-fuel ratio of exhaust gas at an inlet portion of an exhaust gas purification catalytic converter, as compared to the feedback control of air-fuel ratio making use of an oxygen sensor. Then arises such a possibility that the adsorption and desorption of oxygen molecules onto and from the catalytic converter surface are not effectively caused, so that the efficiency for simultaneously purifying the three components ($NO_x$, CO, and HC) may be deteriorated.

SUMMARY OF THE INVENTION

The present invention has been achieved in view of the circumstances as described above, and it is therefore an object of the present invention to provide a method and an apparatus for feedback controlling an air-fuel ratio making use of a wide range air-fuel ratio sensor, in which the purifying performance of an exhaust gas purification catalytic converter is exhibited to the utmost.

Therefore, the method/apparatus for feedback controlling an air-fuel ratio according to the present invention is constituted to include a wide range air-fuel ratio sensor which detects an air-fuel ratio over a wide range, in response to a concentration of a specific component in exhaust gas, an air-fuel ratio controlling step/device for controlling the air-fuel ratio of an engine intake mixture to a target air-fuel ratio, based on the detected result of the wide range air-fuel ratio sensor, and a target air-fuel ratio oscillating step/device for oscillating the target air-fuel ratio at a predetermined period with a predetermined amplitude.

According to such a constitution, even when the air-fuel ratio feedback control for controlling the air-fuel ratio of the engine intake mixture to a target air-fuel ratio is executed based on the detected result of the wide range air-fuel ratio sensor, it becomes possible to oscillate the exhaust gas air-fuel ratio at the inlet portion of an exhaust gas purification catalytic converter at a predetermined period with a predetermined amplitude. Thus, there can be effectively caused the adsorption and desorption of oxygen molecules onto and from the surface of the exhaust gas purification catalytic converter, so that the three components ($NO_x$, CO and HC) can be simultaneously purified with a good efficiency while achieving an air-fuel ratio control with a precision higher than the case of adopting an oxygen sensor.

The target air-fuel ratio may be constituted to be variably set in response to a driving condition. According to such a constitution, it becomes possible to deal with the case in which the target air-fuel ratio is to be varied in response to a driving condition. Thus, the precision of air-fuel ratio control is further improved.

The target air-fuel ratio oscillating step/device may be constituted to variably set the predetermined period and the predetermined amplitude, in response to a driving condition.

According to such a constitution, it becomes possible to favorably deal with that case in which the period and amplitude of air-fuel ratio oscillation is to be varied in response to a driving condition. Thus, there can be more effectively caused the adsorption and desorption of oxygen molecules onto and from the surface of the exhaust gas purification catalytic converter, so that the three components ($NO_x$, CO and HC) can be simultaneously purified as effectively as possible.

Further, the construction may be such that the wide range air-fuel ratio sensor may be disposed at an exhaust upstream side of an exhaust gas purification catalytic converter, and a downstream side air-fuel ratio sensor which detects an air-fuel ratio in response to a specific component in the exhaust gas is disposed at an exhaust downstream side of the exhaust gas purification catalytic converter, and there are provided a learning step/device for learning a deviation of the detected result of the downstream side air-fuel ratio sensor from the target air-fuel ratio and a target air-fuel ratio correcting step/device for correcting the target air-fuel ratio, based on the learning result of the learning step/device, to thereby set a corrected target air-fuel ratio; wherein the air-fuel ratio controlling step/device controls the air-fuel ratio of the engine intake mixture, based on the detected result of the wide range air-fuel ratio sensor, to the corrected target air-fuel ratio which is set by the target air-fuel ratio correcting step/device, and the target air-fuel ratio oscillating step/device oscillates, at a predetermined period with a predetermined amplitude, the corrected target air-fuel ratio set by the target air-fuel ratio correcting step/device.

According to such a constitution, it becomes possible to correct such as detection errors of air-fuel ratio such as caused by manufacturing dispersion of the air-fuel ratio sensor or a change with the passage of time, even when the target air-fuel ratio is not actually achieved due to such detection errors though the air-fuel ratio itself is controlled to the target air-fuel ratio. Thus, it becomes possible to accurately control the actual air-fuel ratio to the target air-fuel ratio. As a result, the high precision of air-fuel control thus the purifying efficiency of the exhaust gas purification catalytic converter can be further promoted to the utmost.

Further objects, advantages and details of the present invention will become more apparent from the following description of a preferred embodiment when read in conjunction with the accompanying drawings.

PREFERRED EMBODIMENT

There will be described hereinafter one embodiment of the present invention, with reference to the accompanying drawings.

Figure 1:
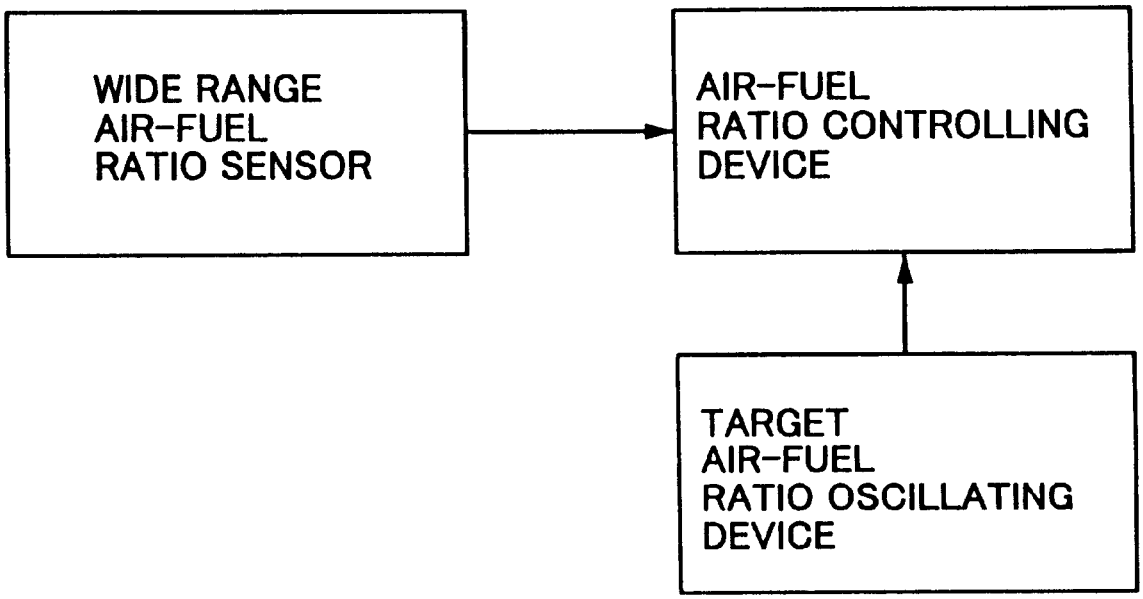
FIG. 1 is a block diagram showing the constitution of the present invention.

The basic constitution of the present invention is shown in the block diagram in FIG. 1.

Figure 2:
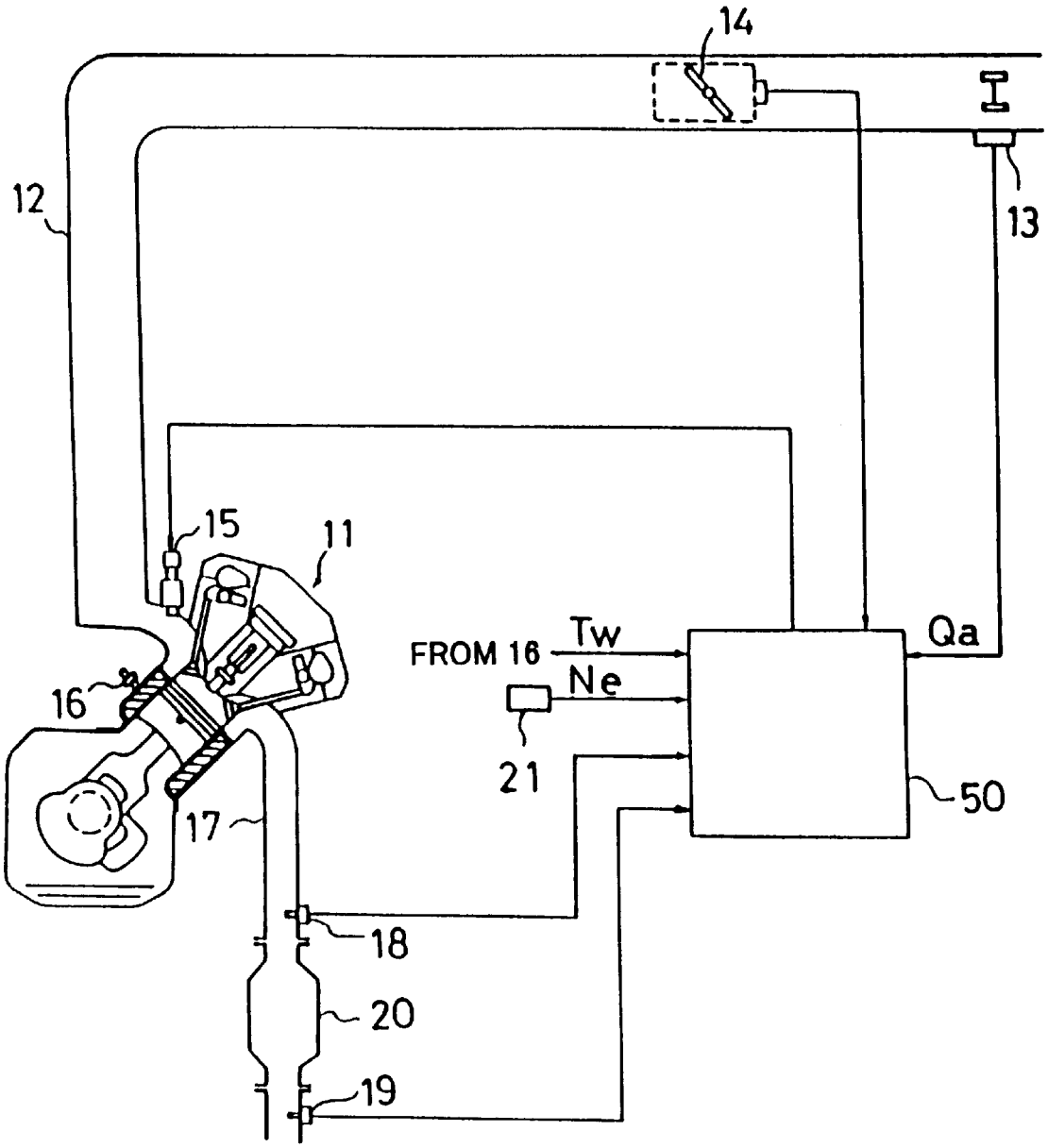
FIG. 2 is a whole constitutional view of one embodiment according to the present invention.

Referring to FIG. 2 showing a whole constitution of one embodiment according to the present invention, provided within an intake passage 12 of an engine 11 are an air flow meter 13 for detecting a quantity of intake air $Q_a$, and a throttle valve 14 for controlling the quantity of intake air $Q_a$ by interlocking with an accelerator pedal, while an electromagnetic fuel injection valve 15 is provided within a downstream manifold part for each of cylinders.

The fuel injection valve 15 is driven to open by a driving pulse signal, which is set by a control unit 50 as will be described later, to thereby injectingly feed fuel, which has been fed under pressure from a fuel pump (not shown) and thereafter regulated to a predetermined pressure. Further, there is provided a water temperature sensor 16 for detecting a water temperature Tw within a cooling jacket of the engine 11. Provided within an exhaust passage 17 near a manifold gathering part is a wide range air-fuel ratio sensor 18 (which will be simply called "air-fuel ratio sensor" hereinafter) for detecting an air-fuel ratio of exhaust gas based on a concentration of a specific component (such as oxygen) in the exhaust gas. Interposed on a downstream side of the sensor 18 is a ternary catalytic converter 20 as an exhaust gas purification catalytic converter for purifying exhaust gas such as by advantageously oxidizing CO and HC and reducing $NO_x$ within the exhaust gas, in the vicinity of the theoretical air-fuel ratio (A/F(air weight/fuel weight) is approximately 14.7; or an air excess ratio $\lambda=1$). As the exhaust gas purification catalytic converter, there may be adopted a so-called lean $NO_x$ catalytic converter, which reduces $NO_x$ such as in a lean (thin air-fuel ratio) range, or a general oxidation catalytic converter.

Disposed at the outlet side of the ternary catalytic converter 20 is a downstream side oxygen sensor 19 (which outputs a rich/lean inversion signal with respect to the theoretical air-fuel ratio) having a function same with the conventional.

Figure 7:
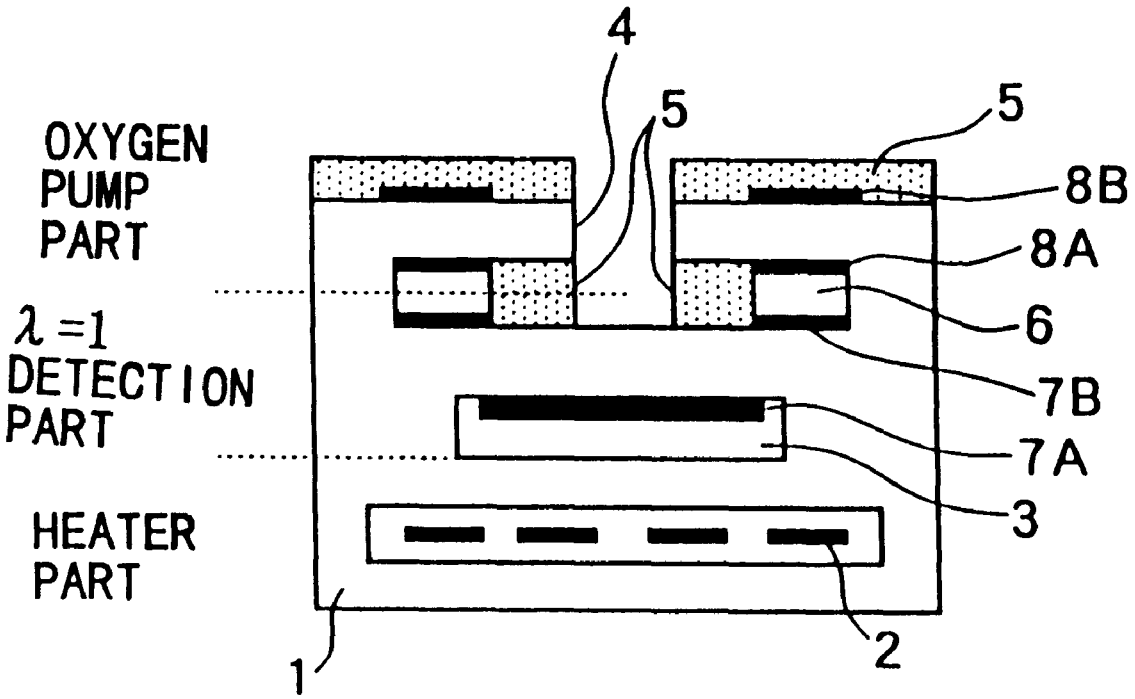
FIG. 7 is a constitutional view of the wide range air-fuel ratio sensor.

The air-fuel ratio sensor 18 adopted in this embodiment may be substituted by the conventional one such as shown in FIG. 7, or anyone insofar as it is adapted to linearly detect the air-fuel ratio over a wide range.

Also, the air-fuel ratio sensor 18 adopted in this embodiment may be substituted by any type of sensor, insofar as it utilizes a detection principle same with that conventional one shown in FIG. 2.

There will be explained hereinafter the structure of air-fuel ratio sensor 18 and the principle of air-fuel ratio detection.

As shown in FIG. 7, provided within a body 1 (such as formed of a heat-resistant porous insulating material such as zirconia $Zr_2O_3$ having oxygen ion conductivity) having a heater part 2, are an air introducing hole 3 communicated with the atmosphere (standard gas), and a gas diffusion layer (or gas diffusion gap) 6 communicated with or exposed to a detection object gas (such as exhaust gas of internal combustion engine) such as via a detection object gas introducing hole 4 and a protection layer 5. Sensing part electrodes 7A and 7B are provided to face to the air introducing hole 3 and gas diffusion layer 6, respectively. Oxygen pump electrodes 8A and 8B are provided around the gas diffusion layer 6 and the periphery of the body 1 corresponding thereto, respectively.

The sensing part electrodes 7A and 7B (sensor part) detect a voltage which is generated correspondingly to the partial pressure ratio of oxygen between these sensing part electrodes, which ratio is affected by the concentration of oxygen ion (partial pressure of oxygen) within the gas diffusion layer 6. The oxygen pump electrodes 8A and 8B (specific component pump part) are applied with a predetermined voltage.

That is, the sensing part electrodes 7A and 7B are adapted to detect the voltage generated by the oxygen partial pressure between these sensing part electrodes, to thereby detect as to which of rich or lean the air-fuel ratio is, relative to the theoretical air-fuel ratio (in which the excess air ratio $\lambda=1$).

Figure 8:
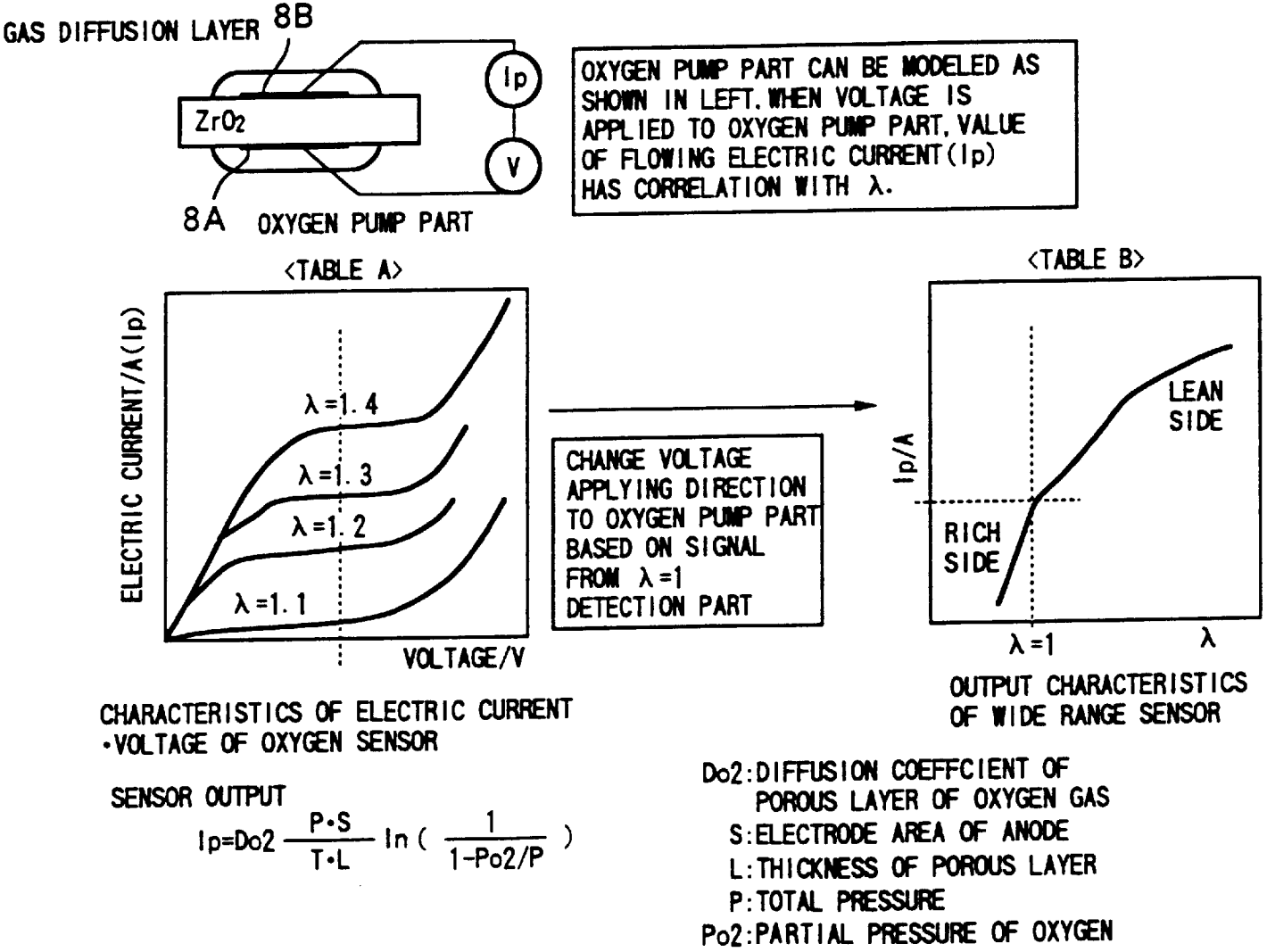
FIG. 8 is a view for explaining the principle for detecting air-fuel ratio in a wide range air-fuel ratio sensor.

In the oxygen pump electrodes 8A and 8B which can be represented by a model shown in FIG. 8, when the predetermined voltage is applied thereto, the oxygen ion within the gas diffusion layer 6 is correspondingly moved, so that an electric current flows between these oxygen pump electrodes 8A and 8B. The electric current value (limit current) Ip, which flows between the oxygen pump electrodes 8A and 8B when the predetermined voltage is applied between these electrodes, is affected by the oxygen ion concentration within the gas diffusion layer 6. Thus, the air-fuel ratio (i.e., excess air ratio λ) of the detection object gas can be detected by detecting such an electric current value (limit current) Ip.

Thus, such as shown in table A of FIG. 8, there can be obtained a correlationship of the electric current/voltage between the oxygen pump electrodes, with the air-fuel ratio (i.e., excess air ratio λ) of the detection object gas.

In the above, an air-fuel ratio can be detected over a wide range, based on the electric current value (limit current) Ip flowing between the oxygen pump electrodes 8A and 8B, in both of the lean and rich air-fuel ratio ranges, by inversing, based on the rich/lean output from the sensing part electrodes 7A and 7B, the voltage applying direction to these electrodes 8A and 8B.

By detecting the electric current value Ip between the oxygen pump electrodes based on the aforementioned air-fuel ratio detection principle, and by referring to table B as shown in FIG. 8, the actual air-fuel ratio (excess air ratio λ) of the detection object gas can be detected over a wide range.

The sensor detected value Ip can be obtained by calculation such as by the following equation:

$$Ip=Do2\times P\times S/(T\times L)\times/N\{1/(1=Po2/P)\}$$

wherein

Do2: diffusion coefficient of oxygen to the porous layer;

S: electrode area of anode;

L: thickness of the porous layer;

P: total pressure;

Po2: partial pressure of oxygen; and

T: temperature.

Turning now to the explanation of the whole system.

There is provided a crank angle sensor 21 internally of a distributor not shown in FIG. 2. The control unit 50 detects an engine rotation speed Ne, by counting, for a fixed time, a crank unit angle signal from the crank angle sensor 21 outputted synchronously with the engine rotation, or by measuring the period of a crank reference angle signal.

The control unit 50 according to the present invention, which functions in a software manner as an air-fuel ratio controlling step or device and as a target air-fuel ratio oscillating step or device, comprises a microcomputer such as including CPU, ROM, RAM, A/D converter and input/output interfaces, and receives input signals from various sensors and, as will be explained hereinafter, controls the injection quantity (i.e., air-fuel ratio control object) of the fuel injection valve 15, to thereby control the air-fuel ratio of the engine intake mixture. The control unit 50 may also be constituted to control an intake air quantity which is another air-fuel ratio control object.

Applicable as the various sensors mentioned above are such as the aforementioned wide range air-fuel ratio sensor 18, downstream side oxygen sensor 19, air flow meter 13, water temperature sensor 16, and crank angle sensor 21.

Figure 3:
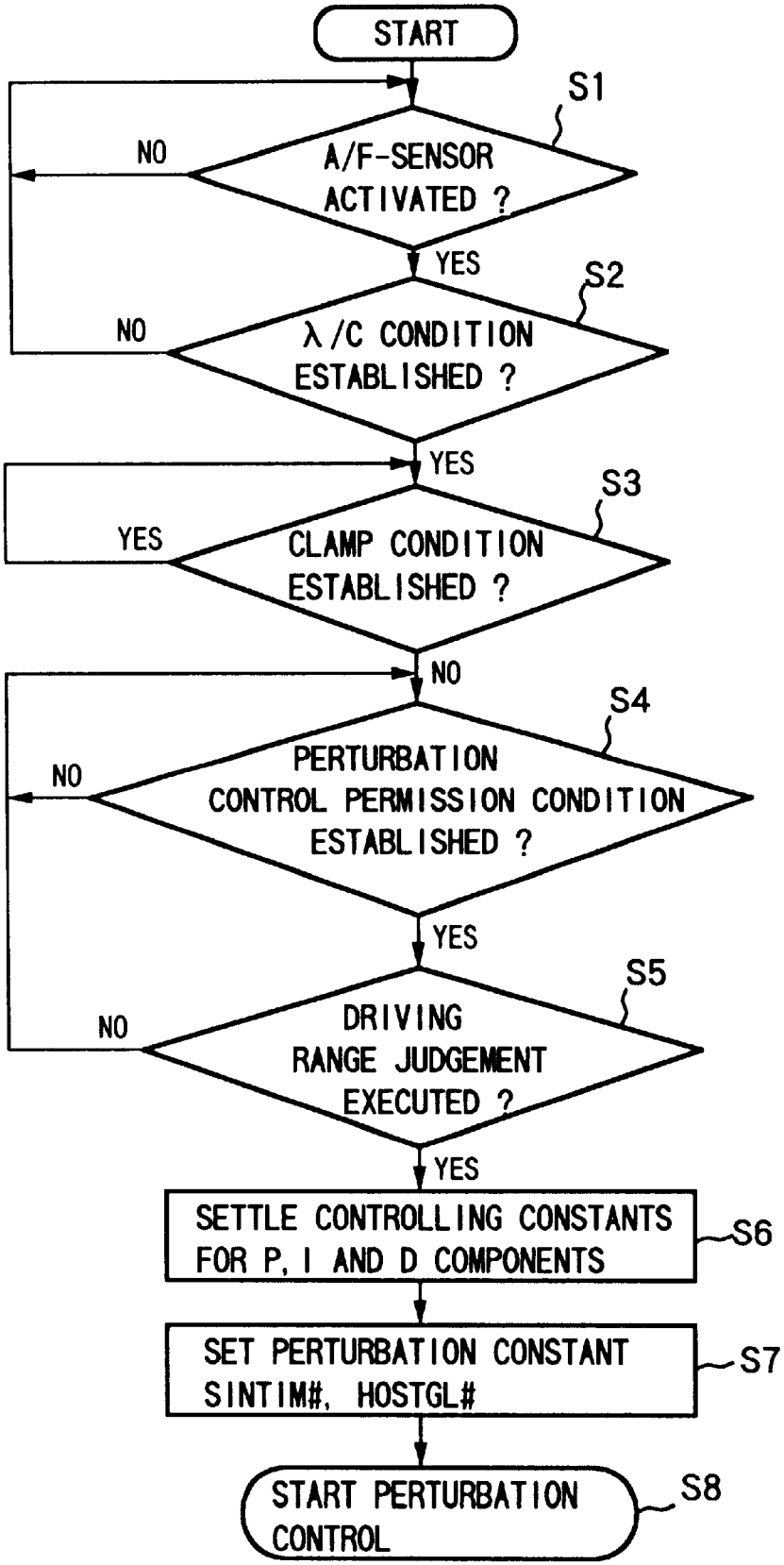
FIG. 3 is a flow chart explaining an air-fuel ratio control in the embodiment.
Figure 4:
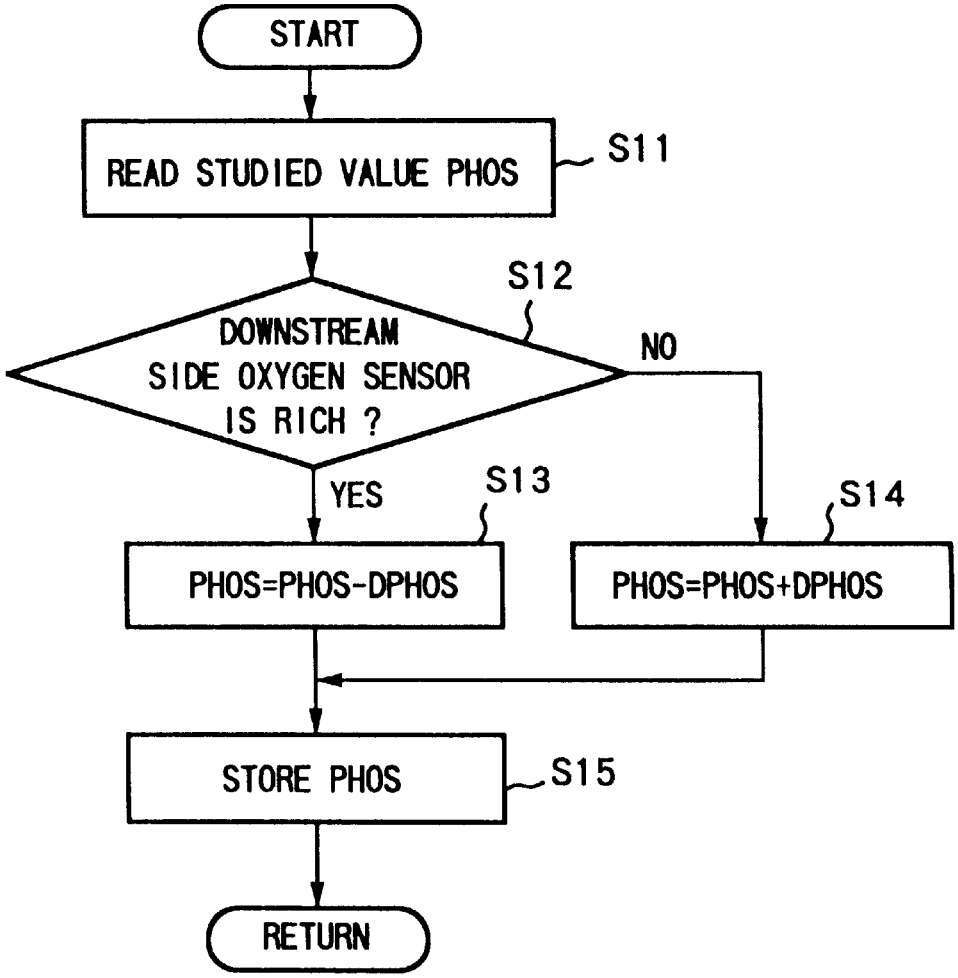
FIG. 4 is a flow chart explaining an update control of a learning value PHOS in the embodiment.

Namely, the microcomputer built in the control unit 50 controls the air-fuel ratio of the engine intake mixture, by executing the processings shown by the flow charts in FIGS. 3 and 4, to thereby determine the fuel injection quantity TI, and output a drive pulse signal, having a pulse width corresponding to this TI, toward each of the fuel injection valves 15 at the timings synchronized with the stroke of each cylinder, to thereby inject fuel. It is preferable to cut fuel (i.e., stop fuel injection) during a predetermined deceleration operation, for reducing fuel cost.

There will be described hereinafter the flow charts in FIGS. 3 and 4.

At step 1 (depicted as "S1" in the figure, and the same rule is applied to hereinafter) in FIG. 3, there is executed an activity judgment on the wide range air-fuel sensor 18 and downstream side oxygen sensor 19 (depicted as "A/F-S" in the figure). This is because the outputs of the wide range air-fuel sensor 18 and downstream side oxygen sensor 19 are unstable under their inactive states, so that it is then preferable to avoid execution of air-fuel ratio control to thereby ensure the precision of the air-fuel ratio control. The activity judgment may be executed such as based on the time lapsed after the engine starting, internal resistances of the sensors, output values from the sensors, or the temperature of engine.

The flow branchingly advances to step 2 if YES (activated), but repeats step 1 if NO (not activated).

At step 2, it is judged as to whether the air-fuel ratio feedback control (λ/C) condition has been established or not.

If YES, the flow advances to step 3, but returns to step 1 if NO.

At step 3, it is judged as to whether a clamp condition for clamping the air-fuel ratio at a predetermined value has been established or not.

If NO, the flow branchingly advances to step 4, but repeats step 3 until the clamp condition is dissolved.

At step 4, it is judged as to whether the permission condition for perturbation control has been established or not. This judgment is done such as by checking as to whether vehicle speed VSP≧predetermined value $A_0$;

predetermined value $A_1$<engine rotation speed Ne≦ . . . predetermined value $B_1$; or predetermined value $A_2$<engine load Tp≦ . . . predetermined value $B_2$.

The flow branchingly advances to step 5 if YES, but returns to step 4 if NO.

At step 5, there is judged the current driving range, such as based on the current engine rotation speed Ne, or engine load (basic fuel injection pulse width) Tp. The flow branchingly advances to step 6 if the range judgment can be executed, but returns to step 4 if not.

At step 6, there are settled the controlling constants for P component (proportional component), I component (integral component), and D component (differential component), as follows:

P=KI×AFD×KITW×IoId

I=KP×AFD×KPTW

D=KD×AFZ×KDTW wherein

KI, KP, KD: correction coefficients of each terms, based on the intake air quantity; and KITW, KPTW, KDTW: correction coefficients (in consideration of catalytic converter activity) depending on the water temperature detected by the water temperature sensor 16.

Each of the coefficients KITW, KPTW, and KDTW is equal to 1 (=1) at ordinary temperatures, and less than 1 (<1) otherwise. Thus, there are contemplated such as: suppression of rotational fluctuation during engine warming up; and activity promotion such as of catalytic converter and air-fuel ratio sensor. Further, in the above equations, AFD=(detected A/F)−(target A/F);

AFZ=(detected A/F)−(the last value of detected A/F; and

IoId: the last value of I component.

Figure 6:
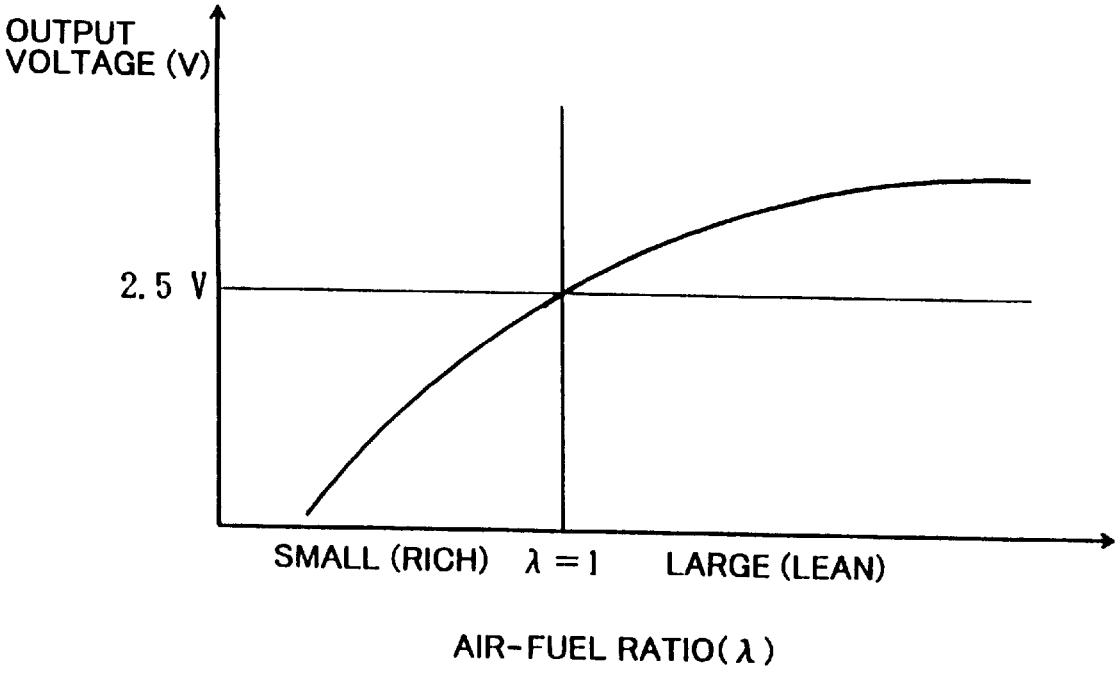
FIG. 6 is a graph showing output characteristics of a wide range air-fuel ratio sensor.

In the above, the detected A/F is obtained in the following manner:

Namely, the value of output voltage V of air-fuel ratio sensor 18 is read out, and the thus read out value is converted to the A/F (air-fuel ratio) by referring to a previously set reference table (which is prepared correspondingly to standard reference characteristics such as shown in FIG. 6 by a solid line).

The A/F such as obtained from the reference table may be further converted to an A/F having a value closer to the true value, by referring to a correction table which has been prepared to correct the individual dispersions of wide range air-fuel ratio sensors 18.

The target A/F (TGLMD) may be obtained such as in the following manner.

Namely, the target A/F is a value obtained in the following equation by adding: PHOS value calculated by DOS (Dual $O_2$ Sensor) control; to a value which is obtained, without interpolative calculation, by referring to a three-dimensional map TBLPID to be determined by 8 lattices of each of engine rotation speed Ne and engine load (basic fuel injection pulse width) Tp:

Target A/F(TGLMD)=TGLMD−PHOSZ

PHOSZ=K#×PHOS.

The PHOS value is calculated every 10 msec, in the PHOS value calculation region, in accordance with DOS control. Further, PHOSZ=0, for the initial value of PHOSZ, and when the learning value of PHOSZ is cleared. K# is a PHOS conversion coefficient for correcting target air-fuel ratio.

There is explained hereinafter the calculation routine of PHOS, with reference to the flow chart of FIG. 4.

Such a routine is executed when the update conditions for the learning value is satisfied such as by the facts that: the downstream side oxygen sensor 19 is in an active state, downstream side oxygen sensor 19 is not being troubled, ternary catalytic converter 20 is in an active state, a predetermined regular state has been established, and engine is not in an idling state.

At step 11, there is read out a learning value PHOS stored correspondingly to the driving range (which is judged at step 5) to which the driving conditions [engine rotation speed Ne, engine load (basic fuel injection pulse width) Tp] belong.

At step 12, the output of downstream side oxygen sensor 19 is compared with a slice level corresponding to a previously set theoretical air-fuel ratio.

If the air-fuel ratio is judged to be in the rich side, the flow branches to step 13 to subtract a fixed value DPHOS (updating width for one time) from the learning value PHOS. Thus, PHOS is updated in the decreasing direction, so that the air-fuel ratio is brought back to the lean side.

Contrary, if the air-fuel ratio is judged to be in the lean side, the flow branches to step 14 to add the fixed value DPHOS (updating width for one time) to the learning value PHOS. Thus, PHOS is updated in the increasing direction, so that the air-fuel ratio is brought back to the rich side. At the time of addition or subtraction of the fixed value DPHOS, it is possible to limit the learning value PHOS by a lower or upper limit value, so as to stabilize the air-fuel ratio control.

At step 15, the learning value PHOS as updated at step 13 or 14 is stored into the same learning range, and the flow is terminated.

In the above, if the downstream side oxygen sensor 19 is in trouble, the learning value PHOS has low reliability. Thus, it is preferable to set PHOS=0 to thereby exclude the learning function.

Turning now to the flow chart of FIG. 3, there is set a constant for the perturbation control, at step 7.

The target A/F (TGLMD), which is calculated in the above manner, is increased or decreased at each of the predetermined time SINTIM#, by a value HOSTGL# which is obtained, without interpolative calculation, by referring to a map HOSTBL for TGLMD oscillation to be determined by 8 lattices of each of engine rotation speed Ne and engine load (basic fuel injection pulse width) Tp. The Ne and Tp lattice axes of HOSTBL are all identical with those of TBLPID. Further, TGLMD should be corrected by HOSTGL#, from the subtraction side. It is preferable to variably set HOSTGL# and SINTIM#, in response to the driving condition.

Figure 5:
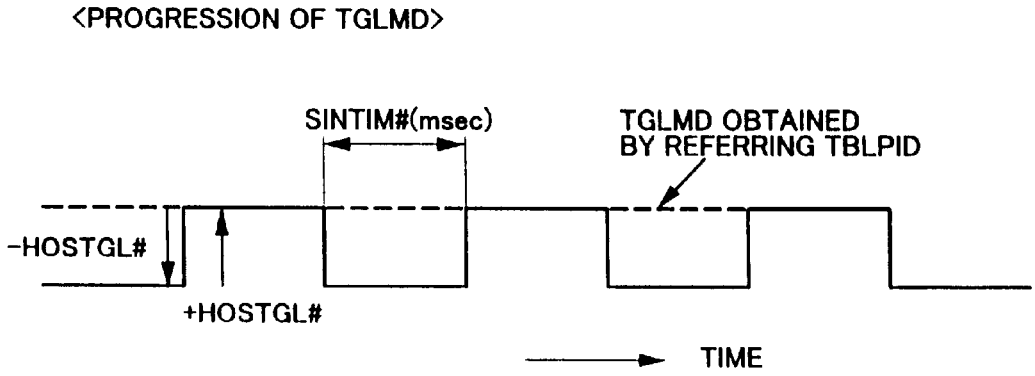
FIG. 5 is a time chart showing a varying state of a target A/F (TGLMD) in the embodiment.

Namely, the target A/F (TGLMD) is forcibly oscillated at a predetermined period with a predetermined amplitude, as shown in FIG. 5.

At the next step 8, the perturbation control is started. Namely, the following processing is performed.

That is, the final fuel injection quantity TI is calculated by the following equation:

$$TI=Tp\times COEF\times ALPHA+TS$$

based on:

the basic fuel injection quantity (basic fuel injection pulse width) Tp (=K×Q/Ne: wherein K is constant), which is obtained from the intake air quantity Q detected based on the signal from the air flow meter 13, and the engine rotation speed Ne detected based on the signal from the crank angle sensor 21, and the correction amount (ALPHA=ALPHA0+P+I+D: wherein ALPHA0 is a previously set reference value; ALPHA is a correction coefficient, here) for air-fuel ratio feedback control, which is calculated based on the aforementioned P, I, and D components;

in the above equation:

COEF indicates various correction coefficients such as including water temperature correction, and TS is a voltage correction component (invalid injection time component) depending on the battery voltage.

Based on the final fuel injection quantity TI calculated in the manner described above, a driving pulse signal having the pulse width of the TI is output, at the injection timing of each of the relevant cylinders, to the fuel injection valve 15 to achieve fuel injection. As a result, the air-fuel ratio at the inlet portion of the ternary catalytic converter 20 is forcibly oscillated at a predetermined period with a predetermined amplitude.

Namely, according to this embodiment, there can be executed a so-called perturbation control in which the exhaust air-fuel ratio at the inlet portion of the ternary catalytic converter 20 is oscillated at a predetermined period with a predetermined amplitude, even if the air-fuel ratio is feedback controlled making use of the detected result of the wide range air-fuel ratio sensor 18. Thus, there can be effectively caused the adsorption and desorption of oxygen molecules onto and from the surface of the ternary catalytic converter 20, so that the three components ($NO_x$, CO and HC) can be simultaneously purified with a good efficiency while achieving an air-fuel ratio control with a precision higher than the case of adopting an oxygen sensor.

It is also possible to alter the air-fuel ratio controlling pattern such as depending on and in response to exhaust characteristics or driving conditions (such as driving ranges in which: an exhausted amount of $NO_x$ is inherently small; exhausted amounts of CO and HC are inherently small; and/or exhausted amounts of all of $NO_x$, CO and HC are inherently small), such that, while omitting the perturbation control in which the air-fuel ratio is oscillated at a predetermined period with a predetermined amplitude, only the air-fuel ratio feedback control is executed in which the air-fuel ratio is maintained at the target air-fuel ratio making use of the output value of the normal type of wide range air-fuel ratio sensor 18.

In the above embodiment, there has been explained for the case where DOS (Dual $O_2$ Sensor) control is performed. However, the present invention can be applied to a single air-fuel ratio sensor control in which the air-fuel ratio control is performed making use of the wide range air-fuel ratio sensor 18 only. In such a case, there are omitted the aforementioned calculation routine for PHOS, and the subtraction and addition of PHOSZ from and to the target A/F (TGLMD). In this concern, it is possible to constitute such that the wide range air-fuel ratio sensor 18 is disposed at the exhaust downstream side of the exhaust gas purification catalytic converter, in case that the air-fuel ratio feedback control is performed making use of the wide range air-fuel ratio sensor 18 only.

What is claimed is:

1. A method for controlling an air-fuel ratio in an internal combustion engine, comprising the steps of:

disposing, at an upstream side of an exhaust gas purification catalytic converter, a wide range air-fuel ratio sensor which detects an air-fuel ratio over a wide range in response to a concentration of a specific component in exhaust gas;

disposing, at a downstream side of said exhaust gas purification catalytic converter, a downstream side air-fuel ratio sensor which detects an air-fuel ratio in response to a concentration of a specific component in exhaust gas;

learning a deviation of the detected result of said downstream side air-fuel ratio sensor from a target air-fuel ratio;

correcting said target air-fuel ratio, based on the learning result of said step of learning, to thereby set a corrected target air-fuel ratio;

oscillating said corrected target air-fuel ratio set by said step of correcting the target air-fuel ratio at a predetermined period with a predetermined amplitude; and controlling the air-fuel ratio of an engine intake mixture to be said oscillated corrected target air-fuel ratio, based on the detected result of said wide range air-fuel ratio sensor.

2. A method of claim 1, wherein said target air-fuel ratio is variably set in response to a driving condition.

3. A method of claim 1, wherein said step for oscillating said target air-fuel ratio comprises a step of variably setting said predetermined period and said predetermined amplitude, in response to a driving condition.

4. An apparatus for controlling an air-fuel ratio in an internal combustion engine, comprising:

a wide range air-fuel ratio sensor disposed at an upstream side of an exhaust gas purification catalytic converter, for detecting an air-fuel ratio over a wide range in response to a concentration of a specific component in exhaust gas;

a downstream side air-fuel ratio sensor disposed at a downstream side of said exhaust gas purification catalytic converter, for detecting an air-fuel ratio in response to a concentration of a specific component in exhaust gas;

learning means for learning a deviation of the detected result of said downstream side air-fuel ratio sensor from a target air-fuel ratio;

target air-fuel ratio correcting means for correcting said target air-fuel ratio, based on the learning result of said learning means, to thereby set a corrected target air-fuel ratio;

target air-fuel ratio oscillating means for oscillating said corrected target air-fuel ratio set by said target air-fuel ratio correcting means at a predetermined period with a predetermined amplitude; and air-fuel ratio controlling means for controlling the air-fuel ratio of an engine intake mixture to be said oscillated corrected target air-fuel ratio, based on the detected result of said wide range air-fuel ratio sensor.

5. An apparatus of claim 4, wherein said target air-fuel ratio is variably set in response to a driving condition.

6. An apparatus of claim 4, wherein said target air-fuel ratio oscillating means variably sets said predetermined period and said predetermined amplitude, in response to a driving condition.

* * * * *